United States Patent [19]

Keeton

[11] 4,444,384

[45] Apr. 24, 1984

[54] CLOTH PICKUP AND FOLDING HEAD

[76] Inventor: John H. Keeton, Box 296, Campbellsville, Ky. 42718

[21] Appl. No.: 283,977

[22] Filed: Jul. 16, 1981

[51] Int. Cl.[3] ..... B65H 3/22

[52] U.S. Cl. ..... 271/18.3; 294/61

[58] Field of Search ..... 271/18.3; 294/61

[56] References Cited

U.S. PATENT DOCUMENTS

| | | | |
|---|---|---|---|
| 793,009 | 6/1905 | Miller | 271/18.3 |
| 3,253,824 | 5/1966 | Southwell et al. . | |
| 3,288,513 | 11/1966 | Behrick | 294/61 X |
| 3,353,821 | 11/1967 | Smith et al. . | |
| 3,386,763 | 6/1968 | Ottaway . | |
| 3,608,890 | 9/1971 | Littlefield . | |
| 4,008,888 | 2/1977 | Vinciguerra | 271/18.3 |

FOREIGN PATENT DOCUMENTS

| | | | |
|---|---|---|---|
| 52-15060 | 2/1977 | Japan | 271/18.3 |

*Primary Examiner*—Richard A. Schacher

*Attorney, Agent, or Firm*—Cushman, Darby & Cushman

[57] ABSTRACT

A simple and effective cloth pickup device including first and second jaws pivotally mounted for movement from a clamping position to an open position. When the jaws are moved into contact with a piece of cloth they are pivoted to clamp the cloth between them, with needles extending from the first jaw piercing the cloth. An overcenter spring holds the jaws in both their first and second positions. When it is desired to release the cloth held by the jaws a plunger is depressed, engaging the jaws and pivoting them to their open position.

14 Claims, 3 Drawing Figures

CLOTH PICKUP AND FOLDING HEAD

BACKGROUND AND SUMMARY OF THE INVENTION

In the handling of cloth, it is often desirable to move a single piece of cloth or like material from a stack to another position, and oftentimes it is desirable to effect a folding of the piece of cloth during, or coincidence with, movement thereof. According to the present invention a cloth pickup and folding head is provided which allows those functions to be accomplished in a simple and effective manner. The cloth pickup and folding head according to the invention has the desirable attributes of few working parts, inexpensiveness, adaptability, ajustability, and ease of construction and repair.

According to the invention a cloth pickup device is provided which comprises first and second jaws. The jaws are mounted so that they are pivotable about first and second axes. The axes are substantially parallel to each other and are spaced so that the jaws are pivotable from a first position wherein they are in operative clamping position with respect to each other to clamp a piece of cloth therebetween, to a second position wherein they are in unobstructed open position to allow a piece of cloth to freely pass into a position therebetween. A cross member with depending side walls and with pivot rods extending through the jaws between the side walls may be provided for mounting the jaws.

In order to secure the jaws in the position to which they have been moved, an overcenter spring means is provided. The overcenter spring includes a coil spring mounted in a cavity in the second jaw and a steel ball bearing pressed by the spring and engaging a depression in the first jaw. The ball bearing is positioned between the jaws so that each line between the ball bearing and a pivot axis makes substantially the same angle with a line between the pivot axes.

A plurality of needles extends through the first jaw, each needle having a needle point extending outwardly from the first jaw to the second jaw to cooperate with the second jaw to pierce and hold the piece of cloth clamped between the jaws when they are in their first position. The needles are screw threaded, or otherwise adjustably mounted, in the first jaw so that the distance the point of each needle extends outwardly from the first jaw may be adjusted.

A mechanical actuating means engages the jaws and moves the jaws from the first position to the second position thereof. The mechanical actuating means comprises a plunger mounted for reciprocal movement through the cross member toward and away from the jaws.

The pickup head according to the invention is normally provided in combination with a conveying system including a conveyor and a stationary stop. A lever arm, or the like, mounted to a power device, mounts the cross member of the pickup head for movement with respect to the stationary stop from a position wherein the stop does not engage the plunger to a position wherein the stop does engage the plunger, and effects pivotal movement of the jaws to the second position. The stop is located above a conveyor belt, or like conveying means. Depending upon the orientation and position of the cloth when picked up by the head, and the position of the stationary stop vis-a-vis the conveying mechanism and pickup head, the cloth may be merely transported from the stack (one piece at a time) to the conveyor belt, or may be folded during movement (such as where T-shirts sleeves are to be folded when utilized with a machine including an automatic hammer).

It is the primary object of the present invention to provide a simple and effective cloth pickup and/or folding device. This and other objects of the invention will become clear from an inspection of the detailed description of the invention, and from the appended claims.

DETAILED DESCRIPTION OF THE DRAWING

Figures 1, 2, 3:
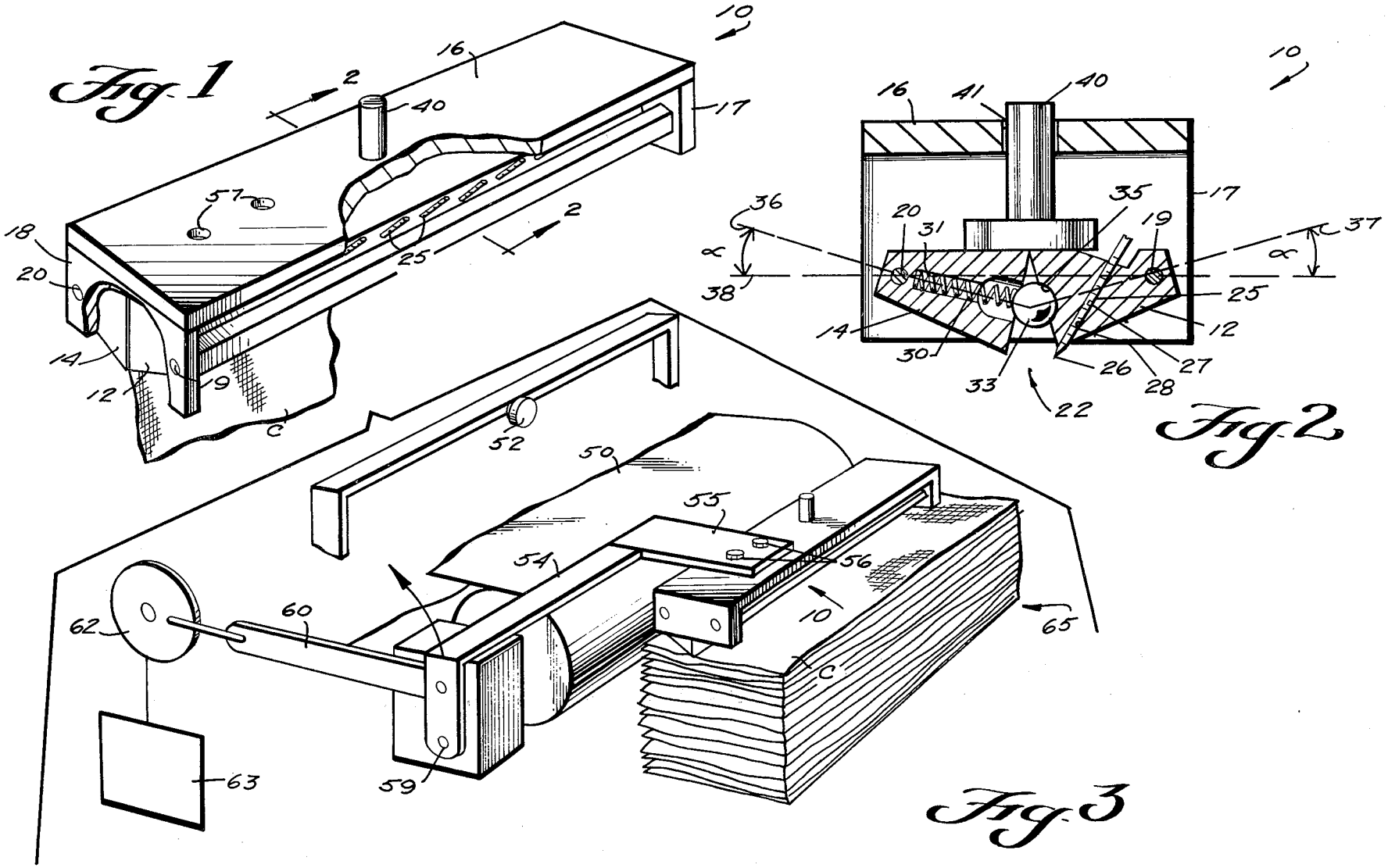
FIG. 1 is a perspective view of an exemplary cloth pickup device according to the invention.
FIG. 2 is a side view—partly in cross section and partly in elevation and taken along lines 2—2 of FIG. 1—of the pickup device of FIG. 1.
FIG. 3 illustrates the pickup device of FIG. 1 in combination with an exemplarary conveying system, material supply, and the like, with which the device may be utilized.

An exemplary cloth pickup device according to the present invention is illustrated generally at 10 in the drawings. The primary operative elements of the device 10 include the first jaw 12, second jaw 14, and means for mounting the jaws for pivotal movement. The pivotal mounting means may comprise, as illustrated in the drawings, a cross member (such as a steel plate) 16 with a pair of side members (such as steel plates) 17, 18 extending downwardly therefrom and integral therewith. First and second pivot rods 19, 20, respectively extend between the side members 17, 18, and pivotally mount the jaws 12, 14 for movement about first and second substantially parallel axes. The components 16, 17, 18, 19 and 20 are dimensioned and spaced so that the jaws 12, 14 are pivotal from a first position (FIG. 1) wherein they are in operative clamping position with respect to each other to clamp the piece of cloth C therebetween, to a second position (FIG. 2) wherein they are in an unobstructed open position to allow a piece of cloth C to pass freely into the open area (indicated generally by reference numberal 22) therebetween.

The first jaw 12 includes a plurality of needles 25 extending therethrough, each needle having a point 26 extending outwardly from the jaw 12 toward the jaw 14 to cooperate with the jaw 14 to pierce and hold a piece of cloth C clamped between the jaws when they are in the first position (FIG. 1). The needles may be dimensioned and positioned along the jaw 12 as necessary for a particular application. In one exemplary embodiment they would be spaced one half inch apart. The needles 25 are mounted in the first jaw 12 so that the distance the point 26 of each extends outwardly from jaw 12 may be adjusted. In the exemplary embodiment illustrated in the drawings, cooperating screw threads 27, 28, provided on each needle 25 and in jaw 12, allow adjustment thereof with respect to each other.

A device is provided for maintaining the jaws 12, 14 in either their first or second position. Such a device preferably takes the form of an overcenter spring means. As seen in FIG. 2, the overcenter spring means preferably comprises a coil spring 30 or the like disposed in a bore 31 formed in the jaw 14, the bore 31 preferably extending radially outwardly from the pivot rod 20. The spring 30 engages and applies a force to a bearing member positioned between the jaws 12, 14. The bearing member preferably takes the form of a steel ball bearing 33, which is received by a depression 35 formed in the first jaw 12. The bearing member 33 is disposed in a position between the jaws as illustrated in FIG. 2, so that each line (36, 37) between the bearing member 33 and the axes (20, 19) respectively makes substantially the same angle $\alpha$ with a line (38) between the axes (19, 20). Any number of overcenter spring mechanisms may be provided in the jaws 12, 14, although normally one centrally located mechanism is sufficient.

In utilization of the device 10 the jaws 12, 14 will normally move from the second position (FIG. 2) to the first position (FIG. 1) thereof when the device 10 is moved into contact with the material it is to hold. However to return the jaws 12, 14 to their open position (FIG. 2) requires some sort of actuator. Preferably a mechanical actuating means, such as the plunger 40 is utilized. The plunger 40 engages the jaws 12, 14, and is reciprocal through an opening 41 formed in the cross member 16. When depressed, the plunger 40 moves the jaws 12, 14, to move the bearing member 33 overcenter and the jaws 12, 14 to the open position illustrated in FIG. 2.

One exemplary use of the device 10 may be seen with reference to FIG. 3. In FIG. 3, the device 10 is shown utilized in combination with a conveying system including a conveyor belt 50 and a stationary stop 52. The device 10 is operatively mounted to a power source, as by an arm 54 attached to a bracket 55, bolts 56 passing through the bracket 55 and being received within openings 57 (see FIG. 1) formed in the cross member 16. The arm 54 is pivotal about a point 59 and is pivotally connected to a lever 60 which in turn is connected to a crank arm assembly 62 powered by an electric motor 63. The device 10 is movable by the arm 54 into operative association with a stack of material 65.

Operation

An exemplary manner of operation of the device 10 in conjunction with the exemplary system illustrated in FIG. 3, will now be described.

The arm 54 moves the device 10 into contact with the top piece of cloth C in the stack 65. When the device 10 is moved downwardly into contact with the cloth C the jaws 12, 14 are pivoted about their axes 19, 20, to the first position (FIG. 1) thereof, at which position the jaws 12, 14 clamped the piece of cloth C therebetween the Cloth being pierced and held by the needle points 26 in operative conjunction with the second jaw 14. During this movement the plunger 40 is reciprocated upwardly to the projecting position illustrated in FIG. 1, and the overcenter spring mechanism 30, 33 holds the jaws 12, 14 in the closed position. As crank arm 62 is rotated, arm 54 moves the head 10 over the conveyor 50 toward the stationary stop 52 mounted above conveyor 50. The cloth C will then drape over the conveyor, and once the plunger 40 engages the stationary stop 52 (which may be a linear cam) it is depressed, moving the jaws 12, 14 to the open position illustrated in FIG. 2, and causing the cloth to be released. The arm 54 is then returned to its position over the stack 65 to pick up the next, top piece of cloth.

It will thus be seen that according to the present invention a simple and effective cloth pickup device is provided which allows a single piece of cloth from a stack to be picked up and transported where desired, and which can be folded depending upon the equipment with which the pickup device cooperates. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A cloth pickup device comprising:

first and second elongated jaws;

means for pivotally mounting said jaws about first and second axes substantially parallel to each other and spaced so that said jaws are pivotable from a first position wherein they are in operative clamping position with respect to each other to clamp a piece of cloth therebetween, to a second position wherein they are in an unobstructed open position to allow a piece of cloth to freely pass into a position between said jaws; and overcenter spring means acting directly on said jaws for maintaining said jaws in either said first or second position thereof once moved to that position.

2. A device as recited in claim 1 further comprising a plurality of needles extending through said first elongated jaw, spaced along the dimension of elongation thereof, and each needle having a needle point extending outwardly therefrom toward said second elongated jaw to cooperate with said second jaw to pierce and hold a piece of cloth clamped between said first and second jaws when said jaws are in said first position, said second jaw being free of needles.

3. A device as recited in claim 2 wherein each of said needles is adjustably mounted in said first jaw so that the distance the point thereof extends outwardly from said first jaw may be adjusted.

4. A device as recited in claim 3 wherein said overcenter means comprises at least one spring received within said second jaw and engaging and applying a force to a bearing member; and means formed in said first jaw for receiving said bearing member therein, said bearing member disposed in a position between said jaws so that each line between said bearing member and the pivot axis for each of said jaws makes substantially the same angle with a line between the pivot axes.

5. A device as recited in claim 4 wherein said overcenter spring means bearing member comprises a ball bearing.

6. A device as recited in claim 4 wherein said mounting means comprises a cross member and a pair of side members extending from said cross member on opposite sides thereof; and first and second pivot rods, each of said pivot rods extending through a respective jaw and mounting the jaw to said side members for pivotal movement with respect thereto.

7. A device as recited in claim 6 further comprising a mechanical actuating means directly engaging said jaws and for moving said jaws from said first position to said second position.

8. A device as recited in claim 7 wherein said mechanical actuating means comprises a plunger mounted for reciprocal movement through said cross member, toward and away from said jaws, and directly engaging said jaws.

9. A device as recited in claim 8 in combination with a conveying system including a conveyor and a stationary stop; and means for mounting said cross member for movement with respect to said stationary stop from a position wherein said stop does not engage said plunger, to a position wherein said stop does engage said plunger effecting pivotal movement of said jaws to said second position thereof.

10. A device as recited in claim 1 wherein said overcenter means comprises at least one spring received within said second jaw and engaging and applying a force to a bearing member; and means formed in said first jaw for receiving said bearing member therein, said bearing member disposed in a position between said jaws so that each line between said bearing member and the pivot axis for each of said jaws makes substantially the same angle with a line between the pivot axes.

11. A device as recited in claim 10 wherein said overcenter spring means bearing member comprises a ball bearing.

12. A device as recited in claim 1 further comprising a mechanical actuating means directly engaging said jaws and for moving said jaws from said first position to said second position.

13. A device as recited in claim 12 wherein said mechanical actuating means comprises a plunger mounted for reciprocal movement toward and away from said jaws; and wherein said device is provided in combination with a conveying system including a conveyor and a stationary stop; and means for mounting said device for movement with respect to said stationary stop from a position wherein said stop does not engage said plunger, to a position wherein said stop does engage said plunger effecting pivotal movement of said jaws to said second position thereof.

14. A cloth pickup device in combination with a conveying system including a conveyor and a stationary stop, comprising:

first and second elongated jaws;

means for pivotally mounting said jaws about first and second axes substantially parallel to each other and spaced so that said jaws are pivotal from a first position wherein they are in operative clamping position with respect to each other to clamp a piece of cloth therebetween, to a second position wherein they are in an unobstructed open position to allow a piece of cloth to freely pass into a position therebetween, said mounting means including a cross member;

means for biasing said jaws to hold said jaws in said first position when moved thereto;

a mechanical actuating means directly engaging both the jaws at the same time and for moving said jaws from said first position to said second position, said mechanical actuating means comprising a plunger mounted for reciprocal movement through said cross member, toward and away from said jaws, and directly engaging said jaws; and means for mounting said cross member for movement with respect to said stationary stop from a position wherein said stop does not engage said plunger, to a position wherein said stop does engage said plunger effecting pivotal movement of said jaws to said second position thereof.

* * * * *